United States Patent [19]

Alder

[11] Patent Number: 4,967,922

[45] Date of Patent: Nov. 6, 1990

[54] CONTAINERS AND CAPS THEREFOR

[75] Inventor: Malcolm Alder, Reading, England

[73] Assignee: Imperial Chemical Industries PLC, London, England

[21] Appl. No.: 346,680

[22] Filed: May 3, 1989

[30] Foreign Application Priority Data

May 3, 1988 [GB] United Kingdom ..... 8810413

[51] Int. Cl.[5] ..... B65D 51/16

[52] U.S. Cl. ..... 215/309; 222/481

[58] Field of Search ..... 215/309; 222/481, 481.5

[56] References Cited

U.S. PATENT DOCUMENTS

| | | | |
|---|---|---|---|
| 1,718,905 | 6/1929 | Howard | 222/481 |
| 1,739,357 | 12/1929 | Gatchell | 222/481 |
| 1,791,350 | 2/1931 | Caron | 222/481 |
| 2,812,117 | 11/1957 | Butkus et al. | 222/481 X |
| 3,467,270 | 9/1969 | Eady | 215/309 |
| 3,813,223 | 5/1974 | Fleck | 215/309 X |

*Primary Examiner*—Donald F. Norton

*Attorney, Agent, or Firm*—Cushman, Darby & Cushman

[57] ABSTRACT

A cap 6 has an outlet 8 and an air bleed valve 10 including a non return valve 18. The non return valve is isolated from the hydrostatic pressure which would prevent it opening, by a housing 12 and a breather tube 13.

3 Claims, 2 Drawing Sheets

CONTAINERS AND CAPS THEREFOR

FIELD OF THE INVENTION

This invention relates to liquid containers and caps therefor.

BACKGROUND OF THE INVENTION

It is desired to withdraw liquid from a sealed container. Such a situation arises in agriculture when it is desired to connect a sealed container to a spraying device and to spray liquid agrochemical from the container onto crops. Normal unsealed arrangements where the container is open to atmosphere allow the possibility of leakage, even via air bleed arrangements, as the liquid slops around in the container in use. There are environmental, health and/or economic reasons for preventing the possibility of leakage.

One proposal enabling the container to be completely closed and yet enabling liquid to be withdrawn is a collapsible container, usually inside a rigid box. There are problems with this, however. For example it is not possible to completely empty the container. The user always pays for more than can be extracted from the container.

In accordance with the invention there is provided, a cap for a liquid container, the cap incorporating an outlet and an air bleed valve, the air bleed valve comprising: a housing opening through the cap, in use, to the outside of the container; a non return valve in the housing to prevent fluid leaving the container via the housing; and a breather tube having one end connected to the interior of the housing downstream of the non return valve, so that when the container is inverted in use, a free end of the breather tube is above the level of the liquid in the container, enabling liquid to be withdrawn from the outlet e.g. by gravity.

In use, the bleeder tube and housing connect the down stream end of the non return valve to air above the liquid level in the container. If the liquid were allowed direct communication with the non return valve, the hydrostatic pressure head would be sufficiently high as to prevent the non return valve opening to allow air to enter the container when liquid is withdrawn, which would prevent the withdrawal of any liquid by gravity.

Preferably, the non return valve comprises a resilient tube, open at one end and closed to a slit at the other end, so that air can flow through the valve from the open end to the slit end but not in the reverse direction.

The cap may be fitted to the feed pipe of an agricultural sprayer, e.g. a hand held back pack sprayer. A container of agrochemical is connected to the sprayer by removing the container's cap and fitting the sprayer's cap. The container is then inverted. Any small amount of the liquid which gets into the bleeder tube is prevented from leaking out by the non return valve.

The invention also extends to a container for liquid, the container incorporating an outlet and an air bleed valve, the air bleed valve comprising: a housing opening through to the outside of the container; a non return valve in the housing to prevent fluid leaving the container via the housing; and a breather tube having one end connected to the interior of the housing downstream of the non return valve, so that when the container is inverted in use, a free end of the breather tube is above the level of the liquid in the container, enabling liquid to be withdrawn from the outlet by gravity.

BRIEF DESCRIPTION OF DRAWINGS

One embodiment of the invention will now be described with reference to the accompanying drawing, in which.

DETAILED DESCRIPTION

Figure 1:
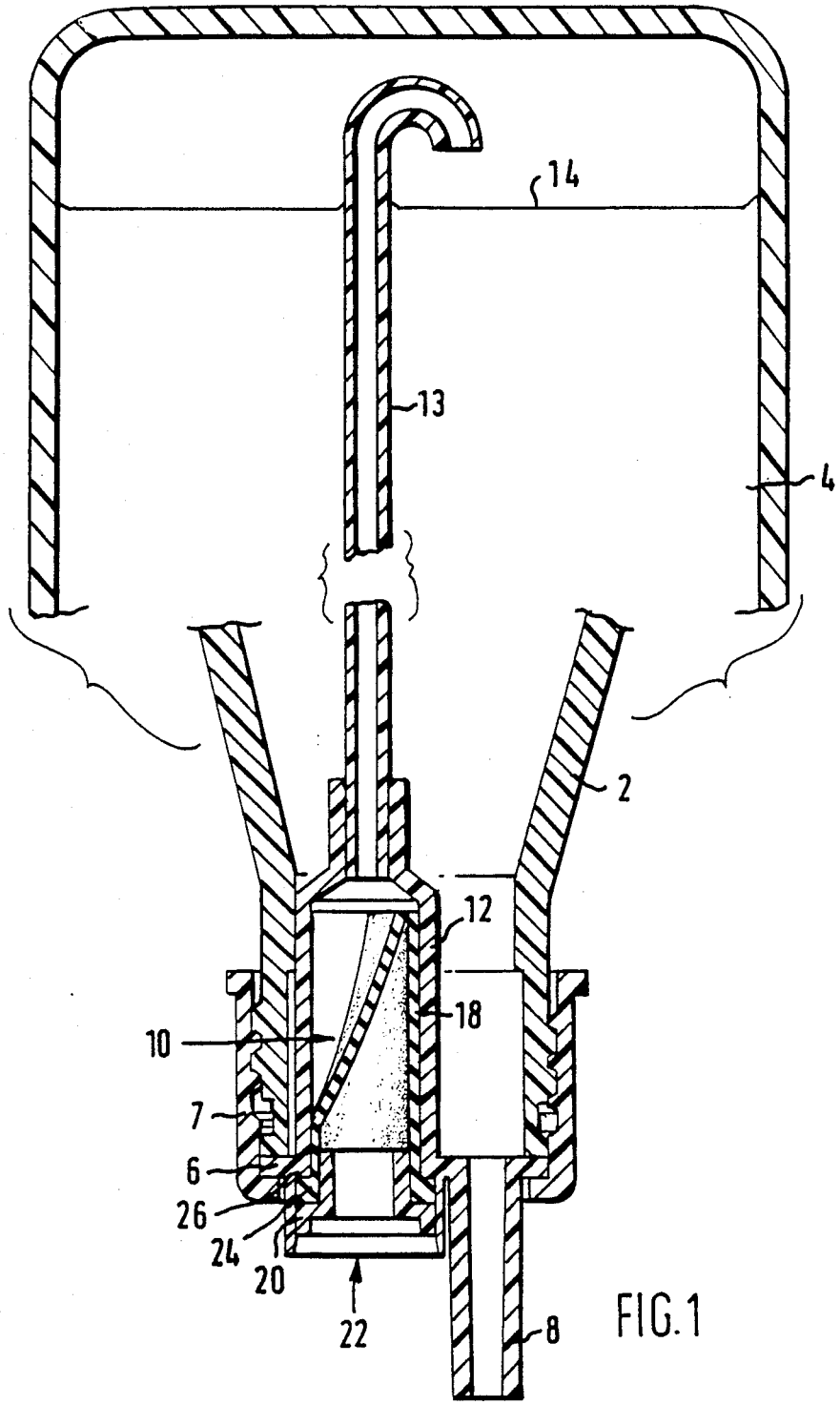
FIG. 1 is a sectional view of a container having a cap embodying the invention, the container being inverted for operation.

Referring to the drawings, a container 2, shown in its inverted operating position in FIG. 1, contains a liquid agrochemical 4. The container has a cap 6 held on by an internally threaded ring 7. Both the container and the cap are moulded of plastics material. The cap 6 is formed with an outlet 8 to which a hand held sprayer (not illustrated) can be connected by flexible plastics tube. In use the container may be carried on the operator's back.

The cap 6 is provided with an air bleed valve 10. The air bleed valve comprises a housing 12 formed integrally with the cap 6. A breather tube 13 extends from the inner end of the housing 12 to a position above the level of the liquid when the container is inverted as shown. The space above the liquid is thus connected to atmosphere, so that air can enter the container to replace liquid 4 withdrawn through the outlet 8.

Figure 2:
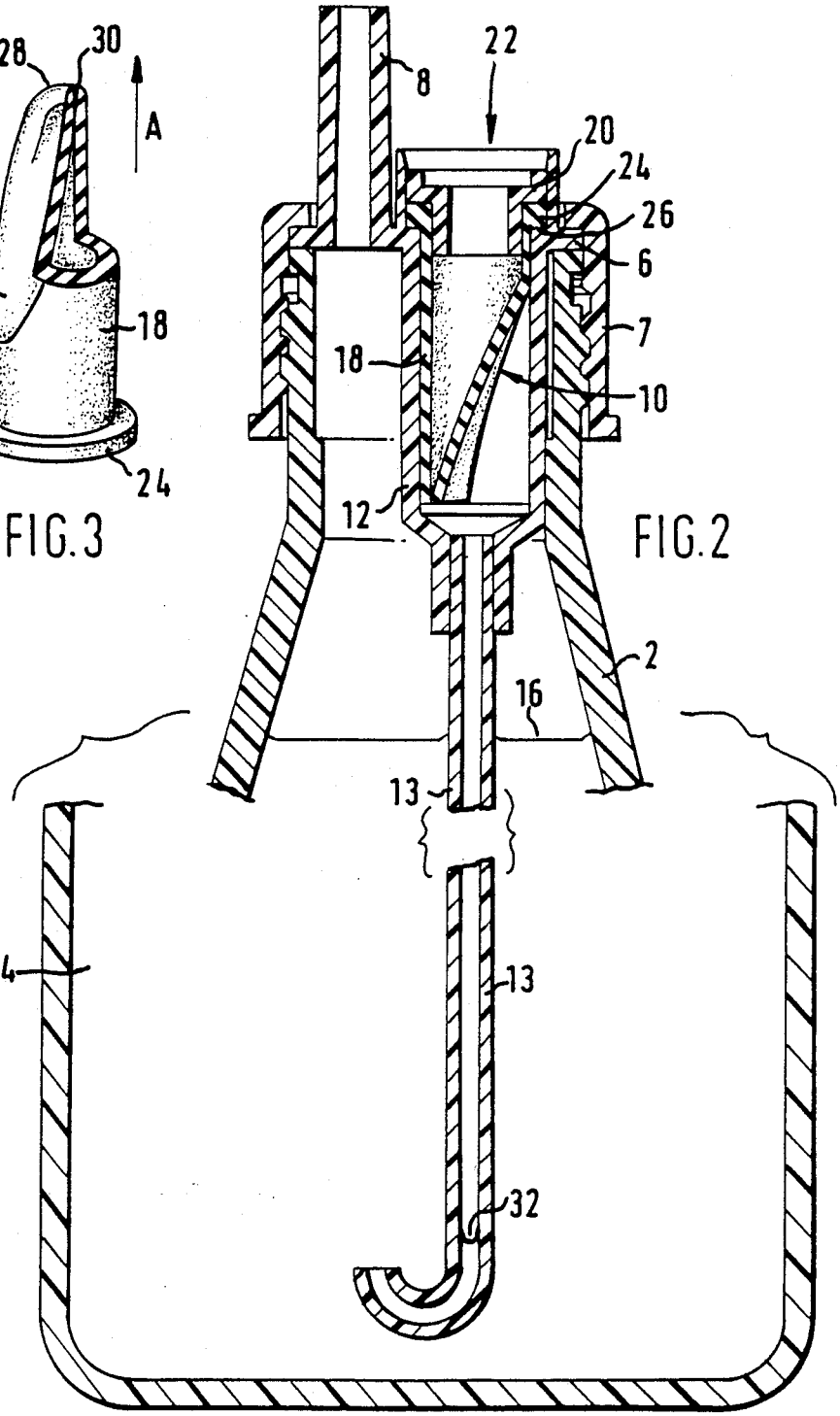
FIG. 2 shows the container of FIG. 1 the normal way up for storage and transit.

With the container 2 its normal way up for transit and storage, as shown in FIG. 2, the water level in the container is shown at 16. If the housing 12 were simply open to atmosphere, the liquid level in the breather tube 13 would correspond to that in the container. As the container was inverted, liquid in the breather tube would drain out through the housing 12.

Figure 3:
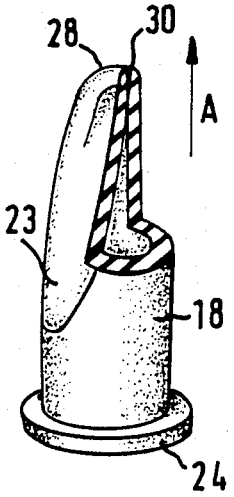
FIG. 3 is a pictorial view showing a non return value partly broken away.

This is prevented by a non return valve 18, shown separately in FIG. 3, which is retained by a stepped ring 20 which is a push or click fit into the open end 22 of the housing 12. The non return valve 18 comprises a resilient rubber tube 23, open at one end which is formed with a flange 24. The flange 24 forms a seal between the retaining ring 20 and a step 26 in the wall of the housing 12. At its other end the tube 23 tapers to a curved edge 28 through which there is a slit 30. The slit is normally closed but opens to allow fluid to pass from in side the tube in the direction of arrow A. However, fluid cannot pass in the return direction. If fluid pressure is applied in the return direction it closes the slit 30 more tightly so preventing fluid from flowing through the valve.

Thus when the cap is being fitted to a container of liquid, air in the breather tube is prevented from exiting by the non return valve 18. Very little fluid therefore enters the breather tube 18, the liquid level in the tube being indicated at 32.

As the container is inverted, an air lock is formed which prevents the liquid draining to the bottom of the inverted tube, i.e. towards the non return valve 18.

The effect of the housing 12 and the breather tube 13 is that when inverted, both sides of the non return valve 18 are at approximately the same pressure, so that the valve can open easily. If the housing 12 and the breather tube 13 were not present, the pressure head of liquid would be sufficient to prevent the valve from opening, so preventing liquid from being withdrawn from the outlet 8.

Although the invention has been described in the environment of an agricultural sprayer, there are clearly many other applications for a container or cap embodying the invention which are not limited to agricultural applications.

What we claim is :

1. A cap for a liquid container, the cap incorporating an outlet and an air bleed valve, the air bleed valve comprising: a housing opening through the cap, to the outside of the container; a non return valve in the housing to prevent fluid leaving the container via the housing; and a breather tube having one end connected to the interior of the housing below the non return valve, so that when the container is inverted in use, a free end of the breather tube is above the level of the liquid in the container, enabling liquid to be withdrawn from the outlet.

2. A cap for a liquid container as claimed in claim 1, wherein the non return valve comprises a resilient tube, open at one end and closed to a slit at the other end, so that air can flow through the valve from the open end to the slit end but not in the reverse direction.

3. A container for liquid, the container incorporating an outlet and an air bleed valve, the air bleed valve comprising: a housing opening through to the outside of the container; a non return valve in the housing to prevent fluid leaving the container via the housing; and a breather tube having one end connected to the interior of the housing below the non return valve, so that when the container is inverted in use, a free end of the breather tube is above the level of the liquid in the container, enabling liquid to be withdrawn from the outlet.

* * * * *